US005160084A

United States Patent [19]

Owen et al.

[11] Patent Number: 5,160,084

[45] Date of Patent: Nov. 3, 1992

[54] METHOD FOR ADHESIVELY BONDING A RAIL-TIE FASTENING ASSEMBLY TO A WOODEN RAILWAY TIE

[75] Inventors: S. Hudson Owen, Marshfield, Wis.; Roger A. Baldwin, Warr Acres, Okla.; Gerald E. Taylor; Paul A. Wolff, both of Oklahoma City, Okla.

[73] Assignee: Kerr-McGee Corporation, Oklahoma City, Okla.

[21] Appl. No.: 819,578

[22] Filed: Jan. 8, 1992

Related U.S. Application Data

[63] Continuation of Ser. No. 414,226, Sep. 29, 1989, abandoned, which is a continuation-in-part of Ser. No. 128,174, Dec. 3, 1987, Pat. No. 4,874,128.

[51] Int. Cl.[5] ..... E01B 2/00; E01B 9/00

[52] U.S. Cl. ..... 238/310; 156/322; 144/348; 238/DIG. 1

[58] Field of Search ..... 238/83, 264, 265, 283, 238/DIG. 1, 310; 156/257, 321, 322, 306.3, 306.9; 144/348; 34/13.8; 29/DIG. 1

[56] References Cited

U.S. PATENT DOCUMENTS

| | | | |
|---|---|---|---|
| 1,704,545 | 3/1929 | Petterson | 238/DIG. 1 X |
| 1,750,735 | 3/1930 | Tupper | 238/DIG. 1 X |
| 2,512,996 | 6/1950 | Bixler | 238/DIG. 1 X |
| 2,690,879 | 10/1954 | Synder | 238/DIG. 1 X |
| 2,886,248 | 5/1959 | Laudig | 238/382 X |
| 3,055,590 | 9/1962 | Mitman | 238/DIG. 1 X |
| 3,242,025 | 3/1966 | Copp | 156/322 X |
| 3,358,925 | 12/1967 | Pennino et al. | 238/382 X |
| 3,558,049 | 1/1971 | Pennino | 238/283 X |
| 3,802,986 | 4/1974 | Forsythe | 156/322 X |
| 3,985,169 | 10/1976 | Chow | 156/322 X |
| 4,231,908 | 11/1980 | Pennino | 238/283 X |
| 4,239,577 | 12/1980 | Hartman et al. | 144/348 X |
| 4,781,778 | 11/1988 | Olofsson | 144/348 X |
| 4,874,128 | 10/1989 | Owen | 238/287 X |
| 4,941,521 | 7/1990 | Redekop et al. | 156/322 X |

FOREIGN PATENT DOCUMENTS

| | | | |
|---|---|---|---|
| 718395 | 9/1975 | Canada | 156/322 |
| 997661 | 9/1976 | Canada | 144/348 |
| 276546 | 10/1964 | Netherlands | 238/264 |

*Primary Examiner*—Michael S. Huppert
*Assistant Examiner*—James Eller
*Attorney, Agent, or Firm*—Herbert M. Hanegan

[57] ABSTRACT

A rail-tie fastening assembly for connecting a rail having a rail flange to a tie comprising a rail seat assembly and a rail anchor. Th rail seat assembly is connectable to the tie and includes an anchor slot and a seat hook assembly. The seat hook assembly is adapted to extend a distance over an upper surface of the rail flange. The rail anchor includes an anchor hook assembly adapted to extend over on the upper surface of the rail flange in an assembled position of the rail anchor to the rail seat assembly. The rail anchor is insertable through the anchor slot in the rail seat assembly to the assembled position. The seat hook assembly is spaced a distance from the upper surface of the rail in the assembled position of the rail anchor to the rail seat assembly. The anchor hook assembly engages one side of the rail flange and the seat hook assembly engages the opposite side of the rail flange to restrain lateral movement. A base anchor is connected to the rail seat assembly and the base anchor is disposable in a cavity formed in an upper surface of the tie and the base anchor is secured to the tie, thereby securing the rail seat assembly to the tie.

2 Claims, 6 Drawing Sheets

METHOD FOR ADHESIVELY BONDING A RAIL-TIE FASTENING ASSEMBLY TO A WOODEN RAILWAY TIE

CROSS REFERENCE TO RELATED APPLICATIONS

This application is a continuation of application Ser. No. 07/414,226, filed Sept. 29, 1989, abandoned , which was a continuation-in part of application Ser. No. 07/128,174, filed on Dec. 3, 1987, now U.S. Pat. No. 4,874,128.

FIELD OF THE INVENTION

The present invention relates generally to fastening means for securing a railroad rail to a cross-tie. More particularly, but not by way of limitation, it relates to a rail-tie fastening assembly having a rail seat assembly connectable to the tie and a rail anchor removably insertable through a portion of and connectable to the rail seat assembly.

DESCRIPTION OF THE PREFERRED EMBODIMENTS

Figure 1:
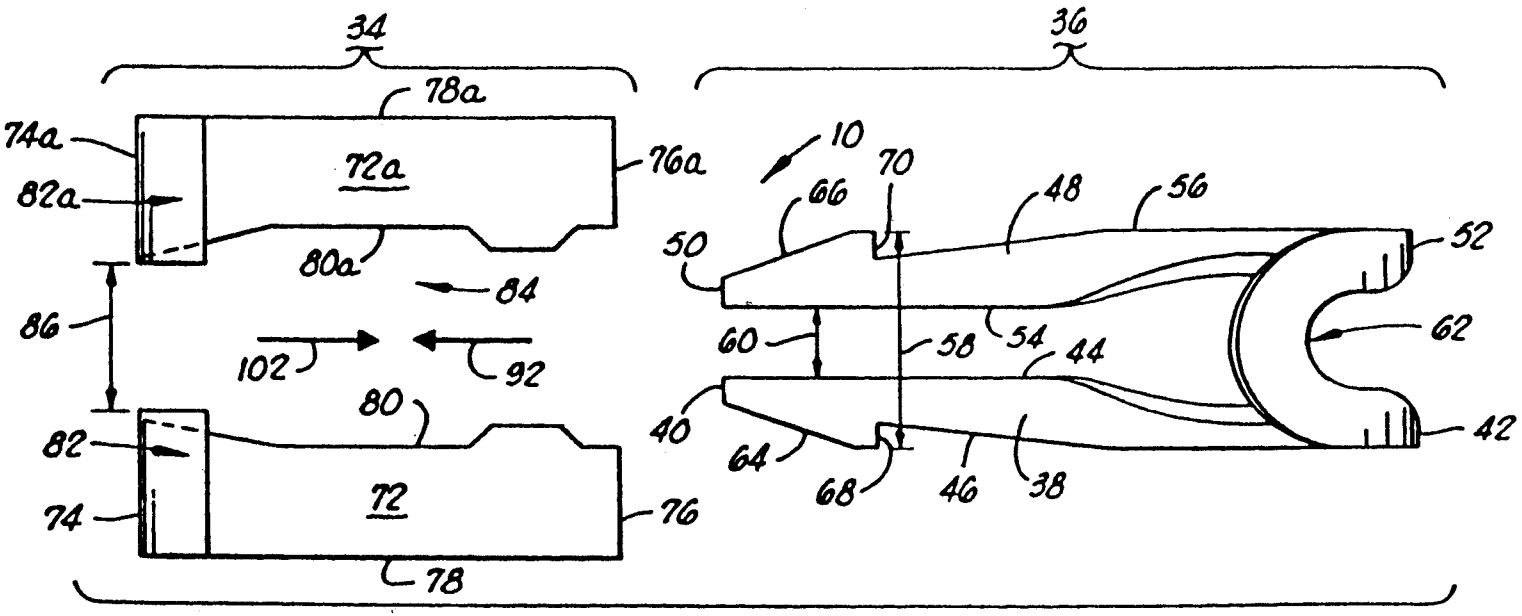
FIG. 1 is a top plan view of a rail-tie fastening assembly showing a rail seat assembly and a rail anchor in an unassembled position, but not showing a base anchor (shown in FIGS. 3, 4, 5 and 6).
Figure 2:
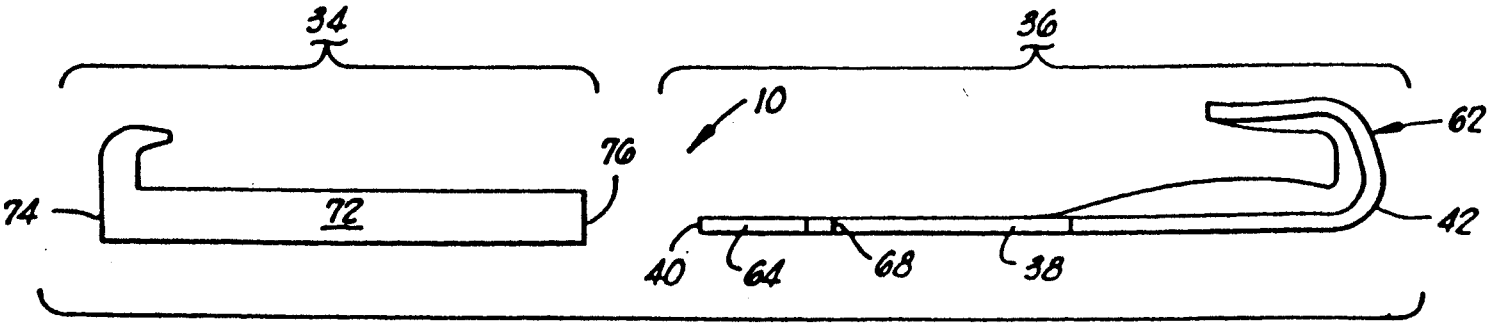
FIG. 2 is a side elevational view of the rail-tie fastening assembly of FIG. 1 showing the rail seat assembly and the rail anchor in the unassembled position, but not showing a base anchor (shown in FIGS. 3, 4, 5 and 6).
Figure 3:
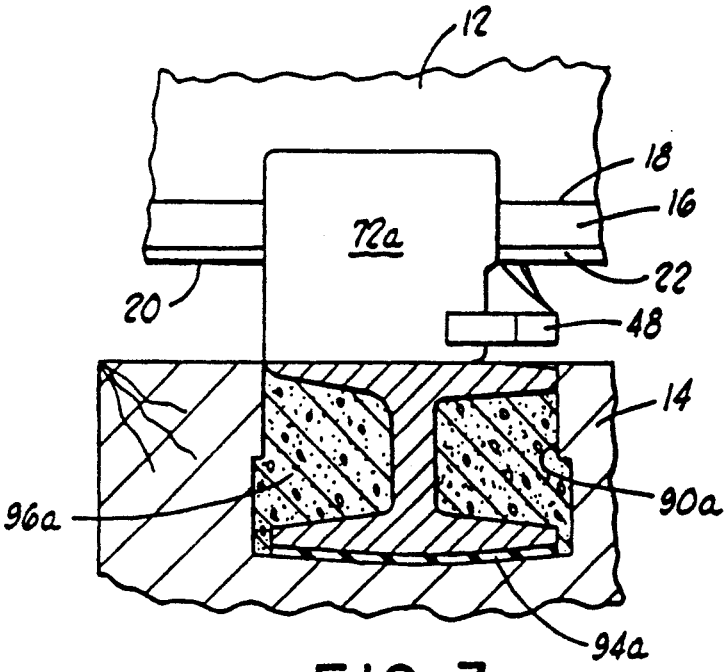
FIG. 3 is a sectional view of a portion of a tie showing a portion of the base anchor used in the installation of the rail seat assembly on a wood tie.
Figure 7:
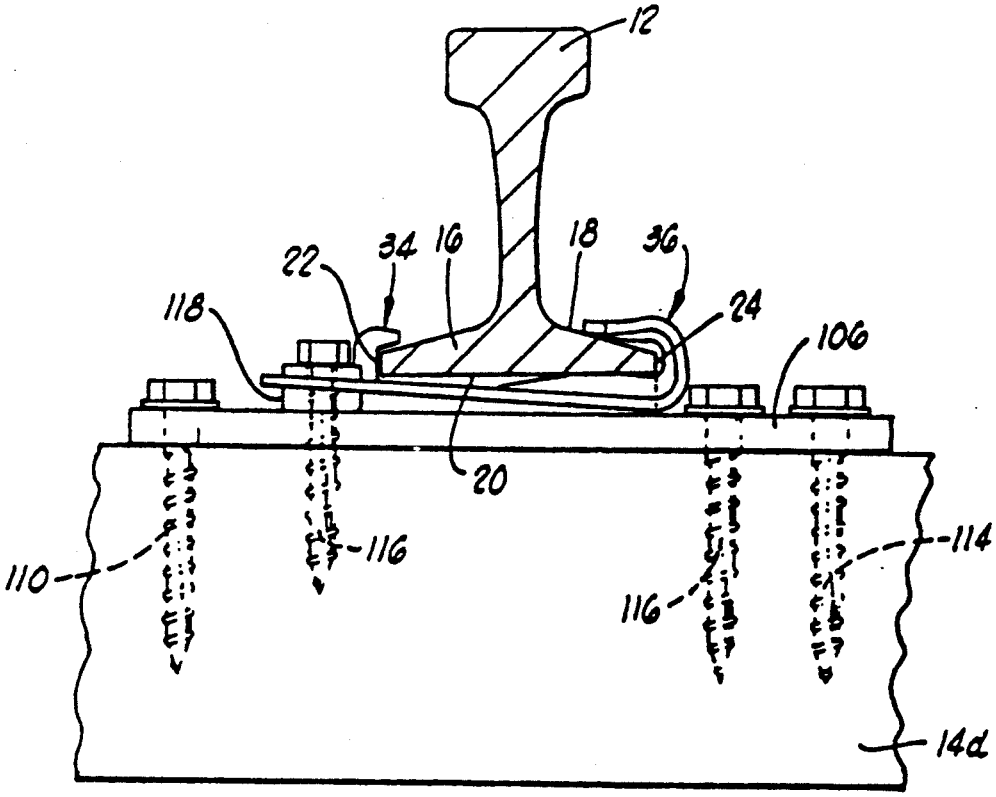
FIG. 7 is a partial side elevational, partial sectional view showing a modified rail tie fastening assembly with the rail seat assembly bolted to a tie.
Figure 4:
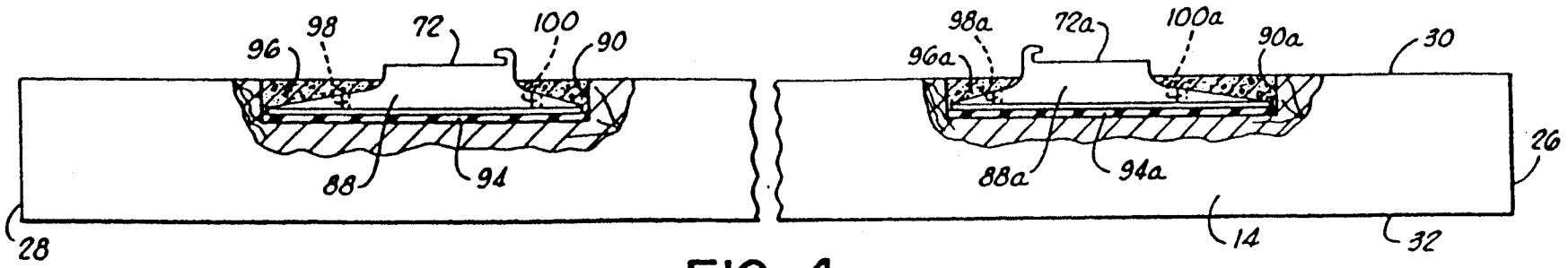
FIG. 4 is a side elevational, partial sectional view of a tie with the two rail seat assemblies installed thereon, a base anchor being shown with each rail seat assembly for cooperating to anchor the rail seat assemblies to the wood tie.

As shown in FIGS. 1, 2, 3 and 4, the present invention comprises a rail-tie fastening assembly 10 which is adapted to connect a rail 12 (FIG. 3) to a tie 14 (FIGS. 3 and 4). The rail 12 (shown in FIG. 3) includes a rail flange 16 having upper and lower surfaces 18 and 20 and a first side 22 and a second side 24 (FIG. 7). As shown in FIG. 4, the tie 14 has first and second ends 26 and 28 and upper and lower surfaces 30 and 32. Each rail-tie fastening assembly 10 includes a rail seat assembly 34 (FIGS. 1 and 2) and a rail anchor 36 (FIGS. 1 and 2).

The rail anchor 36 has a first tine 38 having first and second ends 40 and 42 and first and second sides 44 and 46. The rail anchor 36 also has a second tine 48 having first and second ends 50 and 52 and first and second sides 54 and 56. The second ends 42 and 52 are connected together and the tines 40 and 48 extend in generally parallel planes. The second side 46 of the first tine 38 generally faces and is spaced a distance 58 from the second side 56 of the second tine 48. The distance between the first side 44 of the first tine 38 and the first side 54 of the second tine 48 forms an anchor width 60.

An anchor hook assembly 62 is connected to the second ends 42 and 52 of the first and second tines 38 and 48. In this embodiment, the tines 38 and 48 are integrally constructed from a single unitary piece of metallic material.

A tapered portion 64 (FIG. 1) is formed on the first side 44 of the first tine 38 generally near and intersecting the first end 40. A tapered portion 66 (FIG. 1) is formed on the first side 54 of the second tine 48, generally near and intersecting the first end 50 of the second tine 48.

A seat surface 68 (FIG. 1) is formed on the first side 44 of the first tine 38, generally near the beginning of the tapered portion 64. A seat surface 70 (FIG. 1) is formed on the first side 54 of the second tine 48, generally near the beginning of the tapered portion 66. The seat surfaces 68 and 70 cooperate to secure the rail anchor 36 within the rail seat assembly.

As shown more clearly in FIGS. 1 and 2, the rail seat assembly 34 includes a first rail seat plate 72 having first and second ends 74 and 76 and first and second sides 78 and 80. A first seat hook 82 is formed on the first end 74 of the first rail seat plate 72. The first seat hook 82 is shaped and adapted to engage the first side 22 of the rail flange 16.

As shown in FIG. 1, the rail seat assembly 34 also includes a second rail seat plate **72*a* which is constructed and operates exactly like the rail seat plate 72 described before, except the rail seat plates 72 and 72*a* are left and right configuration adapted to be disposed on opposite sides of the rail anchor 36. Thus, the various components of the rail seat plate 72*a* are designated in the drawings with the same reference numerals as like components of the rail seat plate 72, except the various components of the rail seat plate 72** also include the additional letter designation "a".

As shown in FIGS. 3 and 4, the rail seat plates 70 and **72*a* each are disposed generally on the upper surface 30 of the tie 14. They are disposed generally in parallel extending planes. As shown more clearly in FIG. 1, the second side 80 of the rail seat plate 72 is spaced a distance from the second side 80*a* of the rail seat plate 72*a***.

The second sides 80 and 80*a* cooperate with the spacing therebetween to form an anchor slot 84 in the rail seat assembly 34, and the distance between the second sides 80 and 80*a* comprises a slot width 86.

As shown in FIGS. 3 and 4, a base anchor 88 is connected to the lower surface of the rail seat plate 72. A second base anchor 88*a* is connected to the lower surface of the rail seat plate 72*a*. The base anchors 88 and 88*a* have a generally I-shaped cross section (FIG. 3).

In one embodiment, the base anchors 88 and 88*a* are formed integrally with the respective rail seat plates 72 and 72*a*.

As shown in FIG. 4, a cavity 90 is formed in the upper surface 30 of the tie 14. The cavity 90 is sized to receive the base anchor 88. The cavity 90 and the base anchor 88 each are sized so that, when the base anchor 88 is disposed in the cavity 90, the lower surface of the rail seat plate 72 is disposed in a plane generally coplanar with the upper surface 30 of the tie 14.

A second cavity 90*a* (shown in FIG. 4) is formed in the upper surface 30 of the tie 14 and the second cavity 90*a* is constructed and shaped exactly like the cavity 90. The second cavity 90*a* is sized and shaped to receive the base anchor 88*a* for supporting the rail seat plate 72*a* in a manner exactly like that described before with respect to the cavity 90, the base anchor 88 and the rail seat plate 72.

To install the apparatus of the present invention, the two cavities 90 and 90*a* first are formed in the upper surface 30 of the tie 14. The base anchor 88 along with the rail seat plate 72 connected thereto is disposed in the cavity 90 and the base anchor 88*a* along with the rail seat plate 72*a* connected thereto is disposed in the cavity 90*a*. The base anchors 88 and 88*a* each are positioned in the respective cavities 90 and 90*a* so that the rail seat plates 72 and 72*a* are oriented in the aligned, spaced apart manner described before. In this position, the base anchors 88 and 88*a* each are secured in the respective cavities 90 and 90*a* to secure the rail seat assembly 38 in the upper surface 30 of the tie 14.

After the rail seat assembly 34 has been connected to the tie 14, the rail flange 16 of the rail 12 is positioned generally on the upper surfaces of the rail seat plates 72 and 72*a*. The rail anchor 36 then is positioned so that the first ends 40 and 50 are disposed generally adjacent the anchor slot 84.

In this position, the operator drives the rail anchor 36 in an insertion direction 92 (FIG. 1). As the operator drives the rail anchor 36 in the insertion direction 92, the tapered portions 64 and 66 engage the second sides 80 and 80*a* of the rail seat plates 72 and 72*a* thereby forcing the first ends 40 and 50 generally toward each other. The operator continues to drive the rail anchor 36 in the insertion direction 92 until the tapered portions 64 and 66 have been disposed entirely within the anchor slot 84, thereby resulting in the first and the second tines 38 and 48 being moved generally toward each other to a position wherein the rail anchor 36 has been moved to a compressed position and the anchor width 60 has been reduced to about the same size as the slot width 86.

In this compressed position of the rail anchor 36, the operator continues to force or drive the rail anchor 36 in the insertion direction 92 until the seat surfaces 68 and 70 are moved slightly beyond the first ends 74 and 74*a* of the rail seats 72 and 72*a*. The seat surfaces 68 and 70 form a reduced width portion of the rail anchor 36 thereby permitting the second sides 46 and 56 to be moved apart to a position wherein the first and the second tines 38 and 48 return to a normal position. In the normal position, the seat surface 68 on the first tine 38 engages a portion of the first end 74 of the rail seat plate 72 and the seat surface 70 on the second tine 48 engages a portion of the first end 74*a* of the rail seat plate 72*a*, thereby securing the rail anchor 36 in the assembled position and in the normal position connected to the rail seat assembly 34.

The anchor hook assembly 62 engages the second side 24 of the rail flange 16 and a portion of the anchor hook assembly 62 extends over a portion of the upper surface 18 of the rail flange 16 in the assembled position and in the normal position of the rail anchor 36 connected to the rail seat assembly 34.

After connecting the rail seat assemblies 38 to the tie 14, the tie 14 with the four rail seat assemblies 34 secured thereon is treated with creosote or any other suitable preservative in the case of wood ties 14.

One system for securing the rail seat plate 72 in the cavity 90 is illustrated in FIGS. 3 and 4. An epoxy adhesive 94 initially is disposed on the bottom surface of the cavity 90. The base anchor 88 with the rail seat plate 72 connected thereto then is lowered into the cavity 90 to a position wherein the lower surface is disposed on the epoxy adhesive 94. The remainder of the space in the cavity 90 not occupied by the base anchor 88 is filled with a potting compound 96. The adhesive 94 and potting compound 96 are cured. The potting compound 96 cooperates with the epoxy adhesive 94 to fill the remaining space in the cavity 90 and to secure the base anchor 88 in the cavity 90. The rail seat plate 72*a* is secured to the tie 14 in exactly the same manner.

As shown in FIG. 4, each base anchor 88 and 88*a* includes at least two vent holes 98 and 100 and 98*a* and 100*a*, respectively. Each of the vent holes 98, 100, 98*a* and 100*a* extends through the base anchors 88 and 88*a*, respectively. Each of the vent holes 98, 100, 98*a* and 100*a* intersects the lower end of the respective base anchors 88 and 88*a*.

An excess amount of adhesive is disposed in the cavities 90 and 90*a*. The base anchors 88 and 88*a* with the respective rail seat plates 72 and 72*a* connected thereto are forced into the cavities 90 and 90*a*, respectively, against the epoxy adhesive 94 and 94*a*, respectively. The vent holes 98, 100, 98*a* and 100*a* aid in reducing air pockets in the adhesive 94 and 94*a*.

In one embodiment, the potting compound 96 is made by using the sawdust obtained from routing out of the cavities 90 and mixing the sawdust with a binding agent. The primer also can be placed on the wood surface to enhance bonding to the wood.

It should be noted that an epoxy primer can be disposed on the metal base anchor 88 to render the metal bondable to the epoxy adhesive 94 or the potting compound 96.

The epoxy 94 must have a lap shear test value greater than 750 psig (as defined in Table I below), survive creosote treatment at about 200° F. for 8 to 10 hours, and survive temperature cycling from −20° F. to 120° F. for ten days. The epoxy 94 also must be suitable for about thirty years of outdoor service. Suitable epoxys are commercially available from Ciba Geigy and Fielro Industries.

To remove the rail anchor 36 from assemblage with the rail seat assembly 34, the operator must move the first tine 38 and the second tine 48 generally toward each other to the compressed position wherein the seat surfaces 68 and 70 become disengaged from the first ends 74 and 74*a* of the rail seat plates 72 and 72*a*. In this compressed position of the rail anchor 36, the rail anchor 36 then can be moved in a removal direction 102 through the anchor slot 84 to a position wherein the rail anchor 36 is disengaged from the rail seat assembly 34.

A rail tie fastening assembly constructed exactly like the rail tie fastening 10 described above was disclosed and claimed in the co-pending application entitled "Rail-Tie Fastening Assembly", U.S. application Ser. No. 128,174, filed on Dec, 3, 1987, now U.S. Pat. No. 4,874,128. The disclosure of this patent (U.S. patent application Ser. No. 128,174, now U.S. Pat. No. 4,874,128) specifically is incorporated herein by reference.

In an experiment, fifty test blocks, numbered one through 50 consecutively were prepared. Each test block was three inches square by four inches high. A rod hole having a 0.671 diameter was drilled into each test block and the rod hole was 2.0 inches deep. These samples were cut from air seasoned cross tie segments (some red oak and some white oak). The moisture content of six extra (not used) blocks was determined by drying in an oven at 104° C. to a constant weight. The average moisture content was 28.52% on an as received basis.

Forged steel rods were obtained having an average diameter of 0.640 inches, thereby providing a clearance of 0.015 between the steel rods and the bolt holes for accommodating the adhesive. The rod ends were coated with a releasing agent (paste wax) prior to bonding in order to prevent tensile bias of the lap shear test.

All of the test blocks bolt holes were dried by blowing hot air into each hole, except the test blocks identified in Table I below as "Control Samples". Hot air for drying was supplied by an electric plastic welding torch which was controlled through a powerstat. The drying temperatures and the hole temperatures were monitored with thermocouples disposed in preformed cavities in the test blocks.

The drying temperature was maintained in the range of from 110° C. to 120° C. and the drying time was thirty minutes. The wall and bottom temperatures in the bolt holes were 95° C. to 105° C. and 30° C. to 40° C., respectively.

After drying, epoxy was disposed in the rod holes. The rods then were inserted into the rod holes. Some of the samples (test blocks) were prepared using an epoxy Regency No. 24585 obtained from Fielco using 50 grams part "A" plus 25 grams part "B". Some of the samples (test blocks) were prepared using epoxy from Ciba-Geigy either LMH 276-8A' (epoxy A) or LMH 276-8B' (epoxy B) with a primer obtained from Ciba-Geigy LMH 276-14. After curing of the epoxy, some of the test blocks were treated with creosote.

Some of the test blocks were thermal conditioned by cycling such test blocks at −40° C. to 50° C. into an oven at 60° C. A one hour room temperature equilibration period was included between freezer and oven cycles. The conditioned test blocks were then submitted to shear testings (see Table II A and B below).

The test blocks, identified by number, are shown in Table I below along with an identification of the conditioning of each test block and a summary of the conditions under which the epoxy was cured.

TABLE I

| Tag | Wood Type | Test Block Histories* Bonding | Conditioning |
|---|---|---|---|
| | | Test Formula: Primer A Epoxy B | |
| 1 | Tie Red Oak | Room Temp | Creosoted, Temp cycled |
| 2 | Tie Red Oak | Room Temp | Creosoted |
| 3 | Tie Red Oak | Room Temp | Creosoted, Temp cycled |
| 4 | Tie Red Oak | Room Temp | Creosoted |
| 5 | Tie Red Oak | Room Temp | Creosoted |
| 6 | Tie Red Oak | 2" water | Creosoted, Temp cycled |
| 7 | Tie White Oak | Room Temp | Creosoted |
| 8 | Tie White Oak | Room Temp | Creosoted, Temp cycled |
| 9 | Tie White oak | Room Temp | Creosoted |
| 10 | Tie White Oak | Room Temp | Creosoted, Temp cycled |
| 11 | Tie White Oak | Room Temp | Creosoted |
| 12 | Tie White Oak | Room Temp | Creosoted, Temp cycled |
| | | Test Formula: Primer A Epoxy B | |
| 13 | Tie Red Oak | Room Temp | Creosoted, Temp cycled |
| 14 | Tie Red Oak | Room Temp | Creosoted |
| 15 | Tie Red Oak | Room Temp | Creosoted, Temp cycled |
| 16 | Tie Red Oak | Room Temp | Creosoted |
| 17 | Tie Red Oak | Room Temp | Creosoted |
| 18 | Tie Red Oak | 2" water | Creosoted, Temp cycled |
| 19 | Tie White Oak | Room Temp | Creosoted |
| 20 | Tie White Oak | Room Temp | Creosoted, Temp cycled |
| 21 | Tie White Oak | Room Temp | Creosoted |
| 22 | Tie White Oak | Room Temp | Creosoted, Temp cycled |
| 23 | Tie White Oak | Room Temp | Creosoted |
| 24 | Tie White Oak | Room Temp | Creosoted, Temp cycled |
| | | Test Formula: Fielco Regency 24585 | |
| 25 | Tie Red Oak | Room Temp | Creosoted, Temp cycled |
| 26 | Tie Red Oak | Room Temp | Creosoted |
| 27 | Tie Red Oak | Room Temp | Creosoted, Temp cycled |
| 28 | Tie Red Oak | Room Temp | Creosoted |
| 29 | Tie Red Oak | Room Temp | Creosoted |
| 30 | Tie Red Oak | 2" water | Creosoted, Temp cycled |
| 31 | Tie White Oak | Room Temp | Creosoted, Temp cycled |
| 32 | Tie White Oak | Room Temp | Creosoted |
| 33 | Tie White Oak | Room Temp | Creosoted |
| 34 | Tie White Oak | Room Temp | Creosoted |
| 35 | Tie White Oak | Room Temp | Creosoted, Temp cycled |
| | | Test Formula: Control Samples Primer A Epoxy A | |
| 36 | Tie Red Oak | Room Temp | None |
| 37 | Tie Red Oak | Room Temp | None |
| 38 | Tie Red Oak | Room Temp | None |
| 39 | Tie White Oak | Room Temp | None |
| 40 | Tie White Oak | Room Temp | None |
| | | Test Formula: Control Samples Primer A Epoxy B | |
| 41 | Tie Red Oak | Room Temp | None |
| 42 | Tie Red Oak | Room Temp | None |
| 43 | Tie White Oak | Room Temp | None |
| 44 | Tie White Oak | Room Temp | None |
| 45 | Tie White Oak | Room Temp | None |
| | | Test Formula: Control Samples Fielco Regency 24585 Epoxy, No Primer | |
| 46 | Tie Red Oak | | None |
| 47 | Tie Red Oak | | None |
| 48 | Tie White Oak | | None |
| 49 | Tie White Oak | | None |
| 50 | Tie White Oak | | None |

*All bolt holes hot air dried three minutes
All samples stored in baggies throughout tests
Temperature cycling: −35° C. (overnight) to +60° C. (during day) with hour transition period between each hot and cold cycle; nine total cycles.

The rods had an eye formed in one end for use in lap shear pullout tests. The samples were assembled in a press adapted to maintain straight line pressure on the rods. The rods then were pulled from the test blocks and the pressure required to pull the rods from the test blocks was recorded. The results of these tests are summarized in Tables IIA, B and C below.

TABLE IIA

| Lap Shear Strength Test Results Control (ambient cure only) | | | | |
|---|---|---|---|---|
| | | Pullout Strength, psi | | |
| Sample No. | Oak | 276-8A" | 276-8B" | Fielco 24585 |
| (36, 41, 46) | Red | 1188 | 938 | 1210 |
| (37, 42, 47) | Red | 795 | 928 | 1250 |
| (38, —, —) | Red | 925 | — | — |
| | Avg | 970 | 933 | 1230 |
| (39, 43, 48) | White | 918 | 1445 | 1002 |
| (40, 44, 49) | White | 1073 | 1535 | 1002 |
| (—, 45, 50) | White | — | 1275 | 1178 |
| | Avg | 996 | 1418 | 1060 |

TABLE IIB

| Lap Shear Strength Test Results Creosote Treated | | | | |
|---|---|---|---|---|
| | | Pullout Strength, psi | | |
| Sample No. | Oak | 276-8A" | 276-8B" | Fielco 24585 |
| 2, 14, 26 | Red | 1775 | 1550 | 1438 |
| 4, 16, 28 | Red | 1508 | 1275 | 1512 |
| 5, 17, 29 | Red | 1480 | 1550 | 1812 |
| | Avg | 1588 | 1458 | 1587 |
| 7, 19, 32 | White | 1363 | 1575 | 1100 |
| 9, 21, 33 | White | 805 | 1456 | 1350 |
| 11, 23, 34 | White | 1530 | 1463 | 1300 |
| | Avg | 1233 | 1498 | 1250 |

TABLE IIC

| Lap Shear Strength Test Results Creosote + Temperature Cycled | | | | |
|---|---|---|---|---|
| | | Pullout Strength, psi | | |
| Sample No. | Oak | 276-8A" | 276-8B" | Fielco 24585 |
| 1, 13, 25 | Red | 1400 | 1175 | 1350 |
| 3, 16, 27 | Red | 1325 | 1500 | 1075 |
| 6, 18, 30 | Red | 1550 | 1388 | 1312 |
| | Avg | 1425 | 1354 | 1246 |
| 8, 20, 31 | White | 1288 | 1138 | 1090 |
| 10, 22, 35 | White | 900 | 1413 | 1250 |
| 12, 24, — | White | 1250 | 1375 | — |
| | Avg | 1146 | 1309 | 1170 |

The average lap shear strengths (psi) can be summarized as follows in Table III below.

TABLE III

| Average Lap Shear Strengths (psi) | | | | |
|---|---|---|---|---|
| | | Ciba-Geigy | | |
| | | A" | B" | Fielco |
| Control (ambient cure only) | Red Oak | 970 | 933 | 1230 |
| | White Oak | 996 | 1418 | 1060 |
| Creosote Treatment | Red Oak | 1588 | 1458 | 1587 |
| | White Oak | 1233 | 1498 | 1250 |
| Creosote and thermal cycling | Red Oak | 1425 | 1354 | 1246 |
| | White Oak | 1146 | 1309 | 1170 |

These test results indicate that significant increases in the strength of the epoxy bond are achieved by drying the tie to reduce the moisture content at least around portions of the tie where elements are to be epoxy bonded. These results indicate that the moisture content should be reduced to a moisture content below about 28% and, preferably, the moisture content should be reduced below about 20%. The surface of the tie is dried at a temperature above about 50° C.

As a result of the above test, the cavities 90 and 90*a* should be milled in the tie 12 and the at least the portion of the tie 12 generally around the cavities 90 and 90*a* should be dried to substantially reduce the moisture content at least in the portion of the tie 12 around the cavities 90 and 90*a* to about a 150" depth around the surface formed by the cavities 90 and 90*a*.

The moisture in the tie adversely affects the bonding ability of the epoxy. The drying significantly enhances such bonding ability.

In the embodiments described below where a tie plate is adhesively connected to the upper surface of the tie, at least the surface of the tie to which the tie plate is to be adhesively connected should be dried in accordance with the above procedure prior to adhesively connecting the tie plate to the tie.

The surface on the tie to which the base anchor or the tie plate is to be adhesively connected is dried for a period of time it reduce the surface moisture content to a level compatible with the epoxy being used. The drying time in a particular application preferably is sufficient to reduce the moisture content of the surface to below about 20%.

The term "surface" as used herein referring to the surface to which the rail-tie fastening assembly is to be adhesively connected means the outermost surface area of the tie and a portion of the tie immediately under the outermost surface area inwardly into the tie to a depth of about ⅛ inch.

Figure 5:
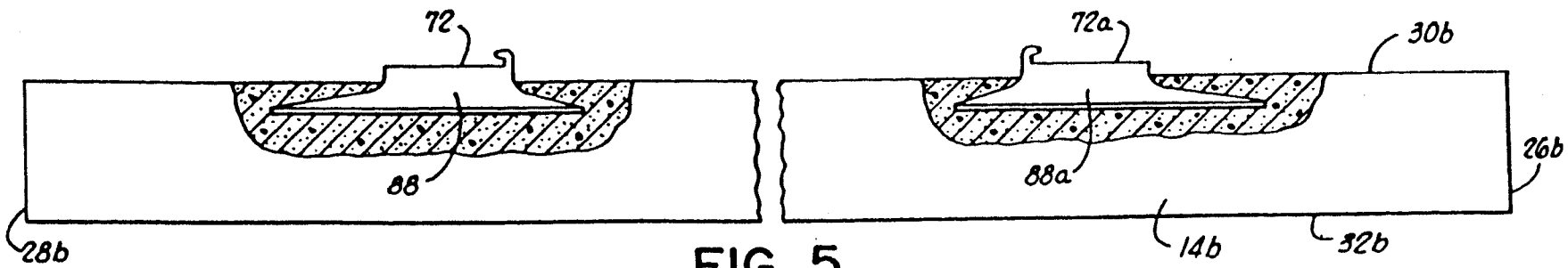
FIG. 5 is a side elevational, partial elevational view of a concrete tie with two rail seat assemblies, a base anchor being shown with each rail seat assembly for cooperating to anchor the rail seat assemblies to the concrete tie.

Embodiment of FIG. 5

Shown in FIG. 5 is the rail seat plates 72 and 72*a* connected to base anchors 88 and 88*a*, respectively, which are embedded in a tie 14*b* which is constructed of concrete. In this embodiment, the concrete tie 14*b* is formed in the usual manner well known in the art, except the concrete tie 14*b* is formed around the base anchors 88 and 88*a*.

Figure 6:
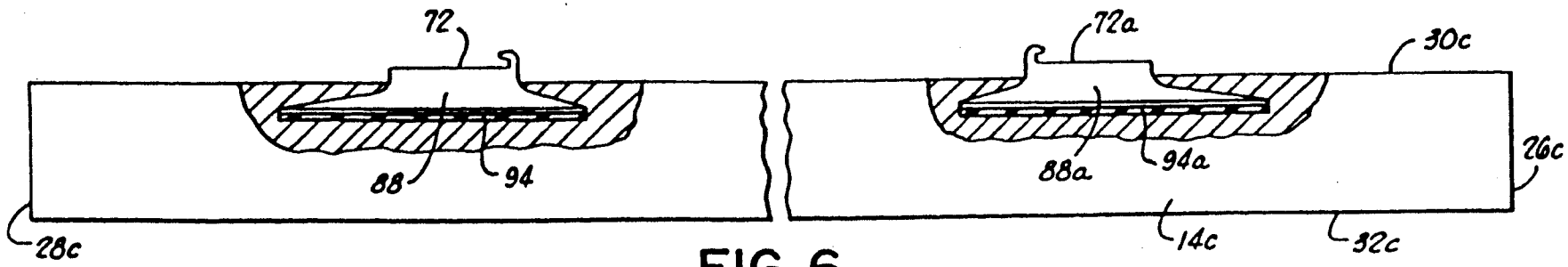
FIG. 6 is a side elevational, partial elevational view of a composite wood tie with two rail seat assemblies, a base anchor being shown with each rail seat assembly for cooperating to anchor the rail seat assemblies to the composite wood tie.

Embodiment of FIG. 6

Shown in FIG. 6 is the rail seat plates 72 and 72*a* connected to base anchors 88 and 88*a*, respectively, which are embedded in a tie 14*a* which is constructed of a wood composite. In this embodiment, the wood composite tie 14*c* is formed around the base anchors 88 and 88*a*. A bonding agent may be required between the wood and metal parts so an epoxy primer 104 and 104*c* is placed on the lower surfaces of the base anchors 88 and 88*a* prior to forming the wood composite tie 14 about the base anchors 88 and 88*a*. The wood composite is made by grinding wood to provide a ground wood supply, drying the ground wood supply to provide a dried ground wood supply and, then, mixing the dried ground wood supply with a bonding agent to provide a wood mixture. The wood mixture is formed or molded around the base anchors 88 and 88*a*.

Figure 8:
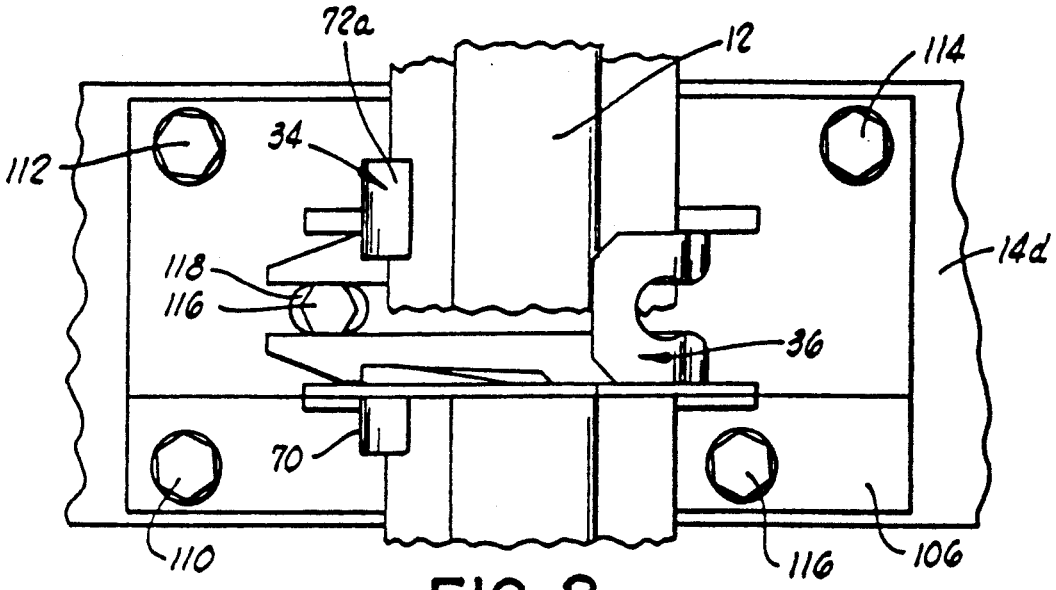
FIG. 8 is a top plan view of the modified rail tie fastening assembly of claim 7.

Embodiment of FIGS. 7 and 8

Shown in FIGS. 7 and 8 is the rail seat assembly 34 and the rail anchor 36 constructed in the manner described before connected to a tie 14*d*. The rail seats 72 and 72*a* are welded or adhesively connected to a tie plate 106. The tie plate 106 is connected to the upper surface of the tie 14*d* via four screws or other suitable attachment means 108, 110, 112 and 114. In this embodiment, the rail seat assembly 34 and the rail anchor 36 are connected to the upper surface of the tie 14*d* via the tie plate 106 and base anchors embedded in the tie like the base anchors 88 described before are not utilized.

A screw 116 extended through a stop head 118 is disposed through the tie plate 106 and through a portion of the tie 14*d*. The screw 116 is disposed so that the stop head 118 is positioned between the tines 38 and 148 in the assembled position of the rail seat assembly 34 and the rail anchor 36 and in the normal position of the rail anchor 36. The stop head 118 prevents the tines 38 and 48 from being inadvertently moved to the compressed position, thereby providing additional assurance that the rail anchor 36 will remain connected to the rail seat assembly 34. To remove the rail anchor 36, it first is necessary to remove the stop head 118 and, then, the tines 38 and 48 can be moved to the compressed position and disassembled from the rail seat assembly 34.

The stop head 118 can be used with the rail-tie fastening assembly 10 shown in FIGS. 1, 2, 3 and 4 and described in detail before.

Figure 9:
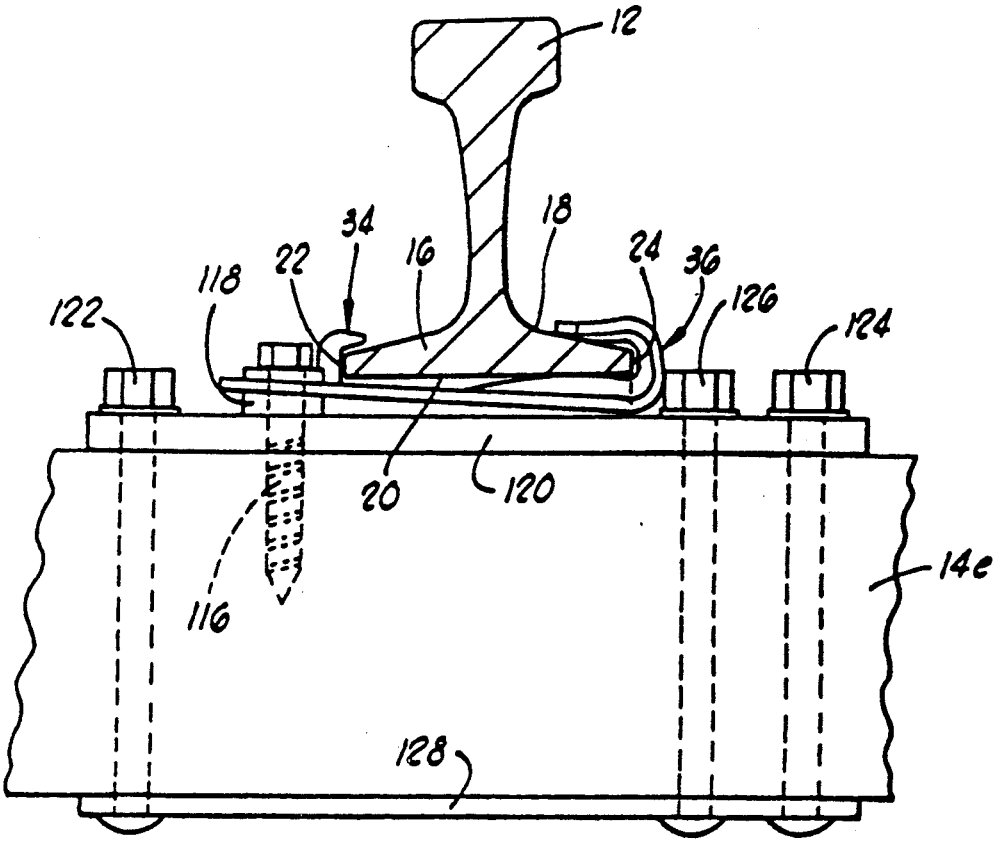
FIG. 9 is a partial side elevational, partial sectional view showing another modified rail tie fastening assembly bolted to a tie.

Embodiment of FIG. 9

Shown in FIG. 9 is the rail seat assembly 34 and the rail anchor 36 constructed in the manner described before connected to a tie 14*e*. The rail seats 72 and 72*a* are welded or adhesively connected to a tie plate 120. The tie plate 120 is connected to the upper surface of the tie 14*e* via four bolts or other suitable attachment means, only three bolts 122, 124 and 126 being shown in FIG. 9. The bolts 122, 124 and 126 extend through the tie plate 120 and through the tie 14*e* and a distance beyond the lower surface of the tie 14*e*.

A lower tie plate 128 is disposed adjacent the lower surface of the tie 14*e*. The bolts 122, 124 and 126 also extend through the lower tie plate 128 and the bolts 122, 124 and 126 are connected to the lower tie plate 128.

Figure 10:
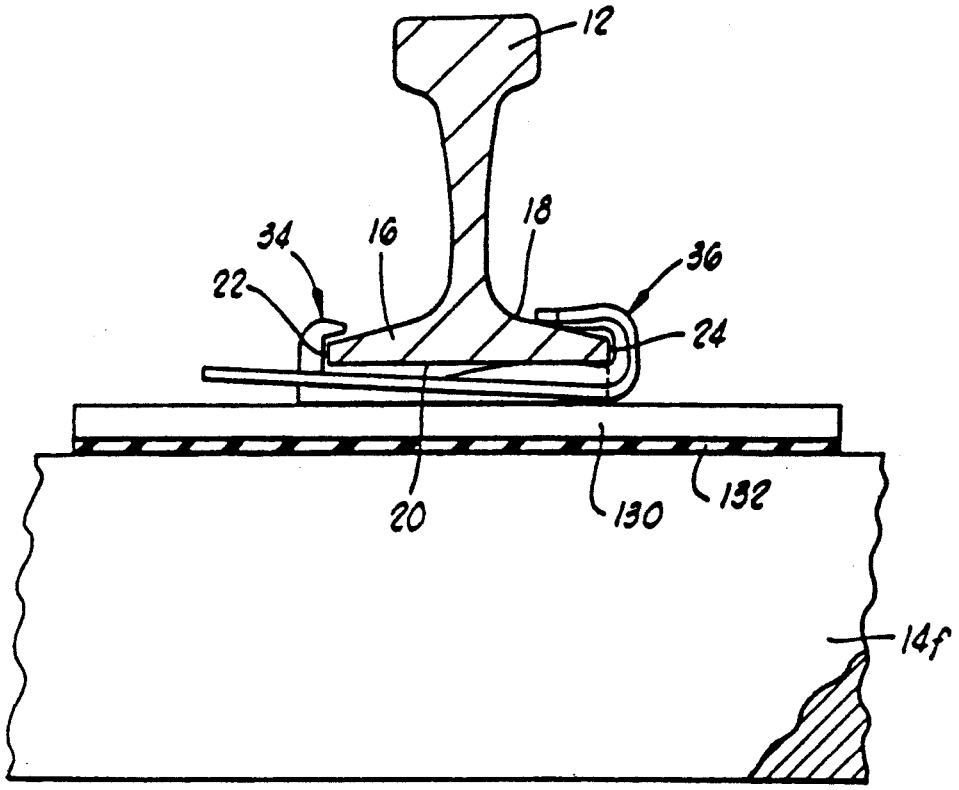
FIG. 10 is a partial side elevational, partial sectional view showing yet another modified rail tie fastening assembly.

Embodiment of FIG. 10

Shown in FIG. 10 is the rail seat assembly 34 and the rail anchor 36 constructed in a manner described before connected to a tie 14*f*. The rail seats 72 and 72*a* are welded or adhesively connected to a tie plate 130. The tie plate 130 is disposed on the upper surface of the tie 14*f*. The tie plate 130 is connected to the tie 14*f* via an epoxy adhesive 132.

Figure 11:
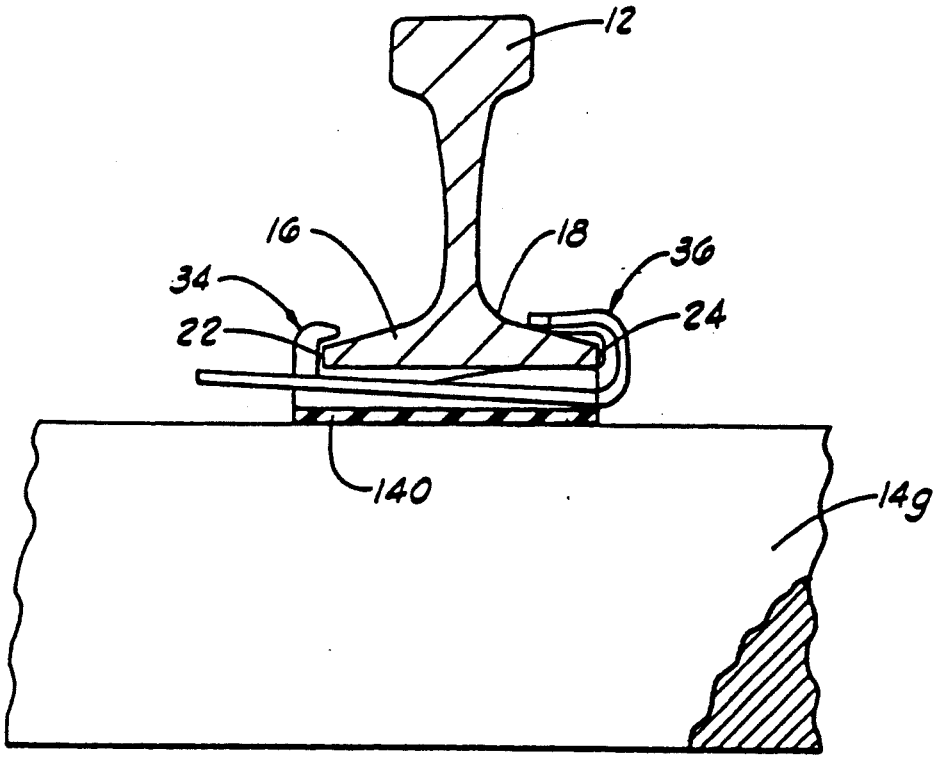
FIG. 11 is a partial sectional, partial elevational view showing the rail seat assembly adhesively connected to the upper surface of a tie and showing the rail seat assembly and rail anchor connected to a rail.

Embodiment of FIG. 11

Shown in FIG. 11 is the rail seat plate 72 or 72*a* connected to the upper surface of a tie 14*g* by way of an adhesive 140 in this embodiment, both of the rail seat plates 72 and 72*a* are directly connected to the upper surface of the tie 14*g* by way of the adhesive 140. The tie 14*g* as shown in FIG. 11 is a steel tie.

Figure 12:
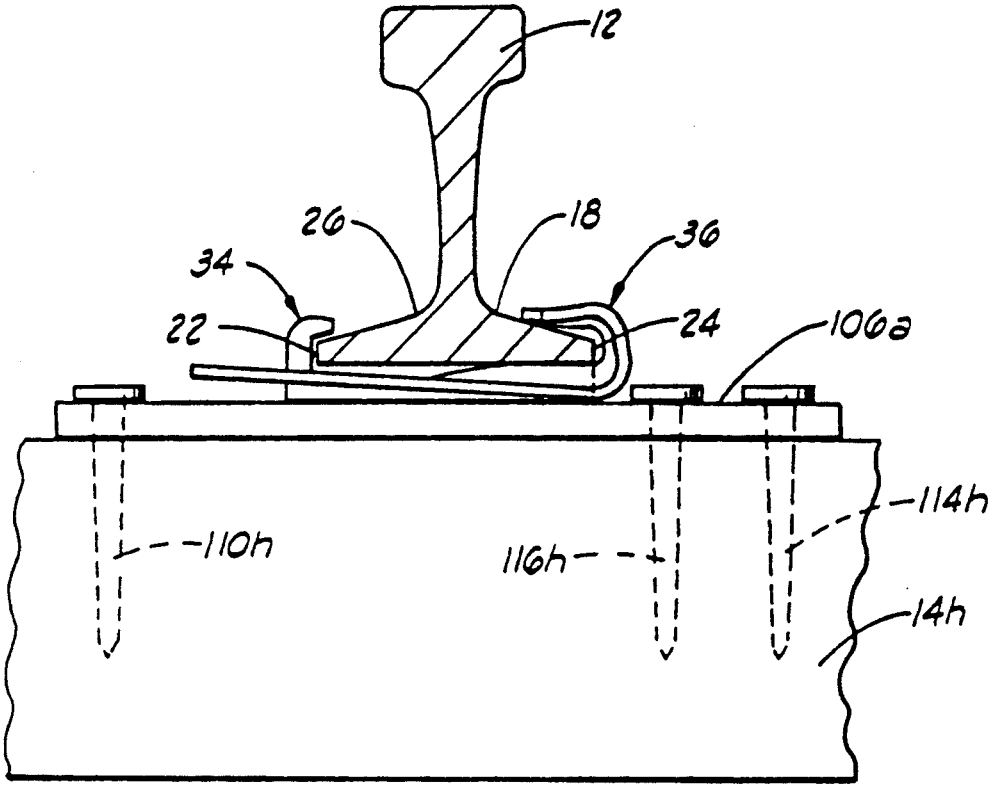
FIG. 12 is a partial sectional, partial elevational view showing the rail seat assembly connected to a tie plate with the tie plate being connected to a tie via rail spikes and showing the rail seat assembly and the rail anchor connected to a rail.

Embodiment of FIG. 12

Shown in FIG. 12 is the rail seat assembly 34 and the rail anchor 36 connected to a tie plate 106*a*. The tie plate 106*a* is connected to the tie 14*h* by way of four spikes (only three of the spikes being shown in FIG. 12 and designated therein by the reference numerals 110*h*, 114*h* and 116*h*). The tie plate 106*a* is constructed like the tie plate 106 shown in FIG. 7 and described before, except the tie plate 106*a* is connected to the rail 14*h* by way of the spikes 110*h*, 114*h* and 116*h* instead of the screws shown in FIG. 7.

Changes may be made in the various components, elements and assemblies described herein and changes may be made in the steps or sequence of steps of the methods described herein without departing from the spirit and the scope of the invention as define in the following claims.

What is claimed is:

1. A method for connecting a rail-tie fastening assembly to a surface of a wood tie, wherein the rail-tie fastening assembly comprises a base anchor means and means attached to the base anchor means for connecting said base anchor means to a rail, comprising:

forming a cavity in the tie sized for accommodating the base anchor means;

drying only an outermost surface of the cavity and a portion of the tie immediately inward into the tie under the outermost surface at a temperature above 50° C. for a period of time sufficient to reduce the moisture content in said surface, which is initially greater than 28 percent by weight, to a level below 28 percent by weight for strengthening an adhesive bond between the base anchor means and the tie;

disposing epoxy adhesive on said surface of the cavity;

disposing the base anchor means in the cavity and on said surface of the cavity in contact with the epoxy adhesive; and permitting the epoxy adhesive to cure for adhesively connecting and bonding the base anchor means to the tie, the epoxy adhesive being the only means for connecting the base anchor means to the tie.

2. The method of claim 1 wherein the step of drying further comprises the drying for a period of time sufficient to reduce the moisture content in said surface below 20 percent by weight.

* * * * *

UNITED STATES PATENT AND TRADEMARK OFFICE

CERTIFICATE OF CORRECTION

PATENT NO. : 5,160,084

DATED : November 3, 1992

INVENTOR(S) : S. Hudson Owen, Roger A. Baldwin, Gerald E. Taylor, and Paul A. Wolff It is certified that error appears in the above-indentified patent and that said Letters Patent is hereby corrected as shown below:

Column 8, line 1, delete "150"" and insert --1/8"--

Signed and Sealed this

Seventh Day of October, 1997

*Attest:*

*Attesting Officer*

Bruce Lehman

BRUCE LEHMAN

*Commissioner of Patents and Trademarks*

Disclaimer and Dedication 5,160,084—S. Hudson Owen, Marshfield, Wis.; Roger A. Baldwin, Warr Acres, Okla.; Gerald E. Taylor; Paul A. Wolff, Oklahoma City, Okla. METHOD FOR ADHESIVELY BONDING A RAIL-TIE FASTENING ASSEMBLY TO A WOODEN RAILWAY TIE. Patent dated Nov. 3, 1992. Disclaimer and dedication filed Apr. 30, 2003, by the assignee, Kerr-McGee Chemical LLC.

Hereby disclaims and dedicates to the Public, the remaining term of said patent.

*(Official Gazette, August 12, 2003)*